US011441100B2

(12) United States Patent
Piorkowski et al.

(10) Patent No.: US 11,441,100 B2
(45) Date of Patent: Sep. 13, 2022

(54) OPACIFIED AND STRUCTURED LIQUID LAUNDRY DETERGENTS CONTAINING COLLOIDAL PARTICLES

(71) Applicant: Henkel AG & Co., KGaA, Duesseldorf (DE)

(72) Inventors: Daniel Thomas Piorkowski, Fairfield, CT (US); Janet Coope-Epstein, Trumbull, CT (US); Peter Schmiedel, Duesseldorf (DE); Frank Meier, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 16/947,209

(22) Filed: Jul. 23, 2020

(65) Prior Publication Data

US 2022/0025295 A1 Jan. 27, 2022

(51) Int. Cl.

| | |
|---|---|
| ***C11D 17/00*** | (2006.01) |
| ***C11D 1/22*** | (2006.01) |
| ***C11D 1/72*** | (2006.01) |
| ***C11D 1/83*** | (2006.01) |
| ***C11D 3/04*** | (2006.01) |
| ***C11D 3/20*** | (2006.01) |
| ***C11D 3/38*** | (2006.01) |
| ***C11D 3/50*** | (2006.01) |
| ***C11D 11/00*** | (2006.01) |
| ***C11D 1/29*** | (2006.01) |
| ***C11D 3/386*** | (2006.01) |

(52) U.S. Cl.

CPC ..... *C11D 1/22* (2013.01); *C11D 1/29* (2013.01); *C11D 1/72* (2013.01); *C11D 1/83* (2013.01); *C11D 3/046* (2013.01); *C11D 3/2082* (2013.01); *C11D 3/2086* (2013.01); *C11D 3/386* (2013.01); *C11D 3/505* (2013.01); *C11D 11/0017* (2013.01); *C11D 17/003* (2013.01)

(58) Field of Classification Search

None

See application file for complete search history.

(56) References Cited

U.S. PATENT DOCUMENTS

| | | | | |
|---|---|---|---|---|
| 3,658,552 | A | 4/1972 | Carlson et al. | |
| 5,616,781 | A | 4/1997 | Sajic et al. | |
| 6,855,680 | B2 | 2/2005 | Smerznak et al. | |
| 8,901,062 | B2 | 12/2014 | De Meirleir et al. | |
| 9,023,786 | B2 | 5/2015 | Schmiedel et al. | |
| 9,187,714 | B2 | 11/2015 | Schmiedel et al. | |
| 2004/0097385 | A1* | 5/2004 | Chen | A61K 8/042 510/130 |
| 2005/0176610 | A1 | 8/2005 | Hsu et al. | |
| 2014/0235524 | A1 | 8/2014 | Schmiedel et al. | |
| 2017/0029747 | A1* | 2/2017 | Depoot | C11D 11/0017 |
| 2018/0216034 | A1* | 8/2018 | Camire | C11D 1/831 |
| 2018/0265816 | A1* | 9/2018 | Lintula | C11D 17/0039 |
| 2019/0264139 | A1* | 8/2019 | Lant | C11D 3/3951 |

FOREIGN PATENT DOCUMENTS

| | | | |
|---|---|---|---|
| EP | 3517596 | A1 | 7/2019 |
| WO | 9725397 | A1 | 7/1997 |
| WO | 2015164515 | A1 | 10/2015 |

OTHER PUBLICATIONS

"Microplastic-Free, Opacified Liquid Laundry Detergents" U.S. Appl. No. 62/938,707 Piorkowski, Daniel Thomas et al. filed Nov. 21, 2019.

International Searching Authority, PCT International Search Report, PCT/US2021/043025, dated Nov. 17, 2021, pp. 1-11, Korean Intellectual Property Office, Daejeon, South Korea.

* cited by examiner

*Primary Examiner* — Lorna M Douyon

(74) *Attorney, Agent, or Firm* — Bojuan Deng

(57) ABSTRACT

An in-vitro opacified and structured detergent composition includes a surfactant component present in an amount of about 7 to about 50 weight percent actives and including (1) an alcohol ethoxy sulfate having a $C_8$-$C_{20}$ backbone that is ethoxylated with from about 1 to about 10 moles of ethylene oxide, (2) at least one non-ionic surfactant comprising an alkoxylated alcohol, and (3) at least one anionic surfactant comprising a linear alkylbenzene sulfonate. The detergent composition also includes water present in a total amount of from about 30 to about 90 weight percent, free fatty acids in a total amount from about 1 to 15 weight percent, a magnesium cation in a total amount of from 0.05 to 1 weight percent, and colloidal particles such as encapsulated fragrances. The composition has a yield point value of at least 0.075 Pa at 20° C.

17 Claims, No Drawings

OPACIFIED AND STRUCTURED LIQUID LAUNDRY DETERGENTS CONTAINING COLLOIDAL PARTICLES

FIELD OF THE INVENTION

The present invention is in the field of cleaning detergents. Specifically, the present invention relates to a liquid detergent with a yield that is both structured and opacified.

BACKGROUND OF THE INVENTION

Liquid laundry detergents may be structured in order to suspend particles therein. Such particles may include colloidal materials (e.g., encapsulated fragrances).

Encapsulated fragrances in liquid laundry detergent are significantly more effective at keeping laundered textiles (clothes) more fragrant than unencapsulated oil. It is possible for encapsulated fragrances to keep laundered textiles scented for over 1 to 3 months, whereas unencapsulated oils may only keep laundered textiles scented for 1 to 10 days. During the washing of textiles with the liquid laundry detergent, encapsulated fragrances can adhere to or become entangled in the fibers of textiles. After drying the encapsulates become brittle and when the textiles are worn, the rubbing of the textile ruptures the dried encapsulate and it releases fragrance that was encapsulated. This mechanism enables a longer efficacious time of encapsulates versus unencapsulated oil.

However, due to the density differences, it is typically not possible to properly suspend fragrances in a liquid detergent composition without use of a structurant. Fragrance oils generally have a density of approximately 0.9 grams/mL, which is lighter than that of detergent liquids (1.01 to 1.10 g/mL). Once they are encapsulated with shells, the density of the encapsulated fragrances may be greater than that of the detergent. Without a structurant, the encapsulated fragrance is only gravitationally stable if the encapsulate's density matches the exact density of the liquid detergent. Otherwise, it will be unstable and the encapsulates will cream upwards if the density is less than the detergent liquid or they will sedimentate if the encapsulate's density is greater than the detergent liquid. This causes differences in the end use of the product for the consumer. The dose to dose concentration of fragrance will be different over time since some bottles of laundry detergents supply over 100 doses of detergent.

If the encapsulated fragrance creamed to the top of the bottle, then the first dose used will have a disproportional amount of fragrance compared to the last dose, in which there would be few encapsulates. This would be undesirable for the consumer since the first dose may be too potent in fragrance strength and the last dose would have little fragrance potency.

To structure detergents, pre-mixed materials are typically added to the liquid. These pre-mixes usually require a heating and homogenization step, which can create complexity to the manufacturing process. One embodiment of known art uses crystallized hydrogenated castor oil (HCO), surfactants and non-amino functional alcohols to structure the detergent, as described in US 2014/0094397 (Guida et al) and US 2018/0037854 (Somerville Roberts et al.). To structure a liquid detergent using the methods described in US 2014/0094397 and US 2018/0037854, an external structuring system (ESS) must first be created.

As described in WO 2011/031940 (Boutique et al.), a mixture of anionic surfactant, water, organic non-amino-functional alcohols, alkanolamines and HCO are heated to 50 to 150 C, emulsified, cooled and then sheared. Afterwards, the ESS is ready to be added to the detergent liquid to structure it.

Therefore, there is a continuous need in the industry to provide a novel, stable structured detergent composition to ubiquitously suspend colloidal particles therein throughout the shelf-life of the product so that each dose, from the first dose to the last dose, has a consistent amount of fragrances and other components in the detergent composition. Preferably, the structuring effect occurs in-vitro and within the mixing vessel to optimize the manufacturing process.

SUMMARY OF THE INVENTION

It has been surprisingly found by the inventors of the present application that certain combinations of magnesium cation, surfactant, water, and free fatty acids can create a stable and structured liquid with a yield capable of suspending encapsulated fragrances. This structuring effect occurs in-vitro and within the mixing vessel and provides stability for at least 3 months and creates a yield point greater than 0.075 Pa. Further, the materials providing the structuring effect are 100% biodegradable, produces a turbidity effect (cloudy visual), and can be achieved without the need of pre-mixes, heating, or additional opacifying or structuring polymers.

Accordingly, in one aspect, the disclosure provides a fluid-gel detergent composition having a yield for transitioning between a gel stage and a fluid stage under sheer stress is provided. The detergent composition comprises: (A) a surfactant system present in an amount of about 7 to about 50 weight percent based on a total weight of the detergent composition, (B) water present in a total amount of from about 30 to about 90 weight percent based on a total weight of the detergent composition; (C) a free fatty acid or a salt thereof present in an amount of from about 1 to about 15 weight percent based on a total weight of the detergent composition, wherein the salt of the fatty acid is capable of being neutralized in the composition to release the free fatty acid; (D) a magnesium salt comprising a magnesium cation component and a counterion component, wherein the magnesium cation component is present in an amount of from about 0.05 to about 1.0 weight percent based on a total weight of the detergent composition; and (E) colloidal particles homogenously dispersed in the detergent composition.

The free fatty acid, or the salt thereof, may be derived from palm kernel or coconut having a $C_{12}$-$C_{20}$ backbone.

The surfactant system of the detergent composition comprises (1) an alcohol ethoxy sulfate having a $C_8$-$C_{20}$ backbone that is ethoxylated with from about 1 to about 10 moles of ethylene oxide; (2) at least one non-ionic surfactant comprising an alkoxylated alcohol; and (3) at least one another anionic surfactant comprising a linear alkylbenzene sulfonate.

In preferred embodiments, the composition is free of a structuring polymer and free of an opacifying agent.

The detergent composition has a yield point value equaling to or greater than 0.075 Pa at 20° C. With this yield point, it is capable of suspending encapsulated fragrances for over 3 months. Before the yield point is reached, the detergent composition acts as a gel or plastic. After the yield point is reached upon applying sheer stress onto the detergent composition, the detergent composition flows freely.

Further, the detergent composition has a turbidity greater than 250 NTU (Nephelometric Turbidity Units) at 75° F. and is substantially free of any crystallized triglycerides-based ESS such as Hydrogenated Castor Oil. Further, this composition requires no pre-mixes and does not require heating above 50C to allow for crystals to be melted so they can re-orientate themselves during the cooling process.

As briefly introduced earlier, the detergent composition exhibits superior and unexpected results. Specifically, it was discovered that a particular combination of surfactants, free fatty acid, water, and magnesium cation at particular weight ratios of actives allows for the stable structuring of the detergent for over 3 months at 75° F. as a liquid in a bottle. This structuring effect only occurs after a minimum amount of magnesium cation is added and occurs instantaneously after all the materials are well blended. Prior to the magnesium cation addition, no material provides opacification or structuring. Further, if not enough magnesium cation or free fatty acid is added, there is no structuring effect. In addition, if too much magnesium cation or free fatty acid is added, the system destabilizes due to becoming too thick and is no longer useful for industrial applications in consumer products since consumers would not be able to dispense the liquid from the bottle.

In another aspect, this disclosure also provides a method in which all materials except for the magnesium cation are well blended together as a transparent composition and then a sufficient amount of the magnesium cation is added as a salt to the composition (e.g. magnesium chloride), which creates an instantaneous opacification and structuring effect (a yield point greater than 0.075 Pa), which slowly increases in yield over time and generally reaches its maximum after 24 hours. This method does not require the use of specific pre-mixes, heating, is free of polymers and is not time sensitive; to allow for polymeric or crystalline components to orientate themselves to allow turbidity or structuring.

DETAILED DESCRIPTION OF THE INVENTION

The following detailed description is merely exemplary in nature and is not intended to limit the disclosure. Furthermore, there is no intention to be bound by any theory presented in the preceding background or the following detailed description.

Embodiments of the present disclosure are generally directed to detergent compositions and methods for forming the same. For the sake of brevity, conventional techniques related to detergent compositions may not be described in detail herein. Moreover, the various tasks and process steps described herein may be incorporated into a more comprehensive procedure or process having additional steps or functionality not described in detail herein. In particular, various steps in the manufacture of detergent compositions are well-known and so, in the interest of brevity, many conventional steps will only be mentioned briefly herein or will be omitted entirely without providing the well-known process details.

This disclosure provides a detergent composition that includes a surfactant system present in an amount of about 7 to about 50 weight percent actives based on a total weight of the detergent composition and including (1) an alcohol ethoxy sulfate having a $C_8$-$C_{20}$ backbone that is ethoxylated with from about 1 to about 10 moles of ethylene oxide, (2) at least one non-ionic surfactant including an alkoxylated alcohol, and (3) at least one another anionic surfactant including a linear alkylbenzene sulfonate. The detergent composition also includes free fatty acid, typically derived from palm kernel or coconut having a $C_{12}$-$C_{20}$ backbone present in a total amount of from about 1 to about 15 weight percent based on a total weight of the detergent composition. The detergent composition also includes water present in a total amount of from about 30 to about 90 weight percent based on a total weight of the detergent composition and a magnesium salt with the magnesium portion present in an amount of from about 0.05 to about 1.0 weight percent actives based on a total weight of the detergent composition. Moreover, the detergent composition has a turbidity greater than 250 NTU (Nephelometric Turbidity Units) at 75° F. and is free of any additional polymers that impart turbidity and creates a yield greater than 0.075 Pa.

In one aspect, the present disclosure provides a detergent composition with a consistent, stable yield that is greater than 0.075 Pa or in another aspect, greater than 0.1 Pa, or in an additional aspect, greater than 0.15 Pa. The detergent composition may be used in a liquid laundry detergent product.

In accordance with another aspect, the present disclosure provides a method in which all materials except for the magnesium cation are well blended together as a transparent composition and then a sufficient amount of the magnesium cation is added as a salt to the composition (e.g. magnesium chloride), which creates an instantaneous opacification and structuring effect. This method is particularly useful for the industry, as transparent and opacified/structured liquid detergents can be created from the same masterbatch (a nearly complete liquid composition with less than 3% of materials withheld for post-dosing, product differentiating materials such as fragrance and dyes), with the transparent liquid detergent having additional water added as the last step and the opacified/structured liquid detergent having magnesium cation added as the last step. This flexibility reduces manufacturing complexity and allows differentiating products to be made from the same masterbatch.

Detergent Composition

This disclosure provides the detergent composition, first introduced above and hereinafter referred to as a composition. The composition may be, include, consist essentially of, or consist of, the surfactant system, free fatty acid, magnesium cation, water and encapsulated fragrance, as each is described below, e.g. in any one or more of the amounts described in greater detail below.

In one embodiment, the composition comprises the surfactant system, free fatty acid, magnesium, encapsulated fragrance, and water.

In another embodiment, the composition consists essentially of the surfactant system, free fatty acid, magnesium, encapsulated fragrance, and water.

In still another embodiment, the composition consists of the surfactant system, free fatty acid, magnesium, encapsulated fragrance, and water.

In yet another embodiment, the composition comprises the surfactant system, free fatty acid, magnesium, encapsulated fragrance, and water, and one or more optional additives described below.

In another embodiment, the composition consists essentially of the surfactant system, free fatty acid, magnesium, encapsulated fragrance, and water, and one or more optional additives described below.

In another embodiment, the composition consists of the surfactant system free fatty acid, magnesium, and water, encapsulated fragrance, and one or more optional additives described below.

In further embodiments, the composition is free of, or includes less than 1, 0.5, 0.1, 0.05, or 0.01, weight percent of, any one or more of the optional components or additives described above or below.

Surfactant System

As introduced above, the composition comprises the surfactant system present in an amount from about 7 to about 50 weight percent actives based on a total weight of the detergent composition. In various embodiments, the surfactant component may be present in an amount from about 10 to about 40, from about 12 to about 38, about 20, 25, 30, 33, 35 weight percent actives based on a total weight of the detergent composition.

The surfactant system comprises, consists essentially of, or consists of, (1) an alcohol ethoxy sulfate having a $C_8$-$C_{20}$ backbone that is ethoxylated with from about 1 to about 10 moles of ethylene oxide, (2) at least one non-ionic surfactant including an alkoxylated alcohol; and (3) at least one another anionic surfactant including a linear alkylbenzene sulfonate. In some embodiments, the weight ratio of all anionic surfactants and all non-ionic surfactants is from 3:1 to 1:3, from 2:1 to 1:2, or about 1:1.

In one embodiment, the surfactant system includes (1) an alcohol ethoxy sulfate having a $C_8$-$C_{20}$ backbone that is ethoxylated with from about 1 to about 10 moles of ethylene oxide, (2) at least one non-ionic surfactant including an alkoxylated alcohol; and (3) at least one anionic surfactant including a linear alkylbenzene sulfonate.

In another embodiment, the surfactant system consists essentially of (1) an alcohol ethoxy sulfate having a $C_8$-$C_{20}$ backbone that is ethoxylated with from about 1 to about 10 moles of ethylene oxide, (2) at least one non-ionic surfactant including an alkoxylated alcohol; and (3) at least one another anionic surfactant including a linear alkylbenzene sulfonate.

In a further embodiment, the surfactant system consists of (1) an alcohol ethoxy sulfate having a $C_8$-$C_{20}$ backbone that is ethoxylated with from about 1 to about 10 moles of ethylene oxide, (2) at least one non-ionic surfactant including an alkoxylated alcohol; and (3) at least one anionic surfactant including a linear alkylbenzene sulfonate.

In a further embodiment, the surfactant system consists of (2) at least one non-ionic surfactant including an alkoxylated alcohol; and (3) at least one anionic surfactant including a linear alkylbenzene sulfonate and is substantially free of (1) an alcohol ethoxy sulfate.

The surfactant system is present in an amount of about 7 to about 50 weight percent actives based on a total weight of the detergent composition. In various embodiments, the surfactant component may be present in an amount from about 10 to about 40, from about 12 to about 38, about 20, 25, 30, 33, 35 weight percent actives based on a total weight of the detergent composition. In various non-limiting embodiments, all values, both whole and fractional, between and including all of the above, are hereby expressly contemplated for use herein.

Alcohol Ether Sulfate

The surfactant system includes the (1) alcohol ethoxy sulfate, which may be described as an anionic surfactant. The alcohol ethoxy sulfate has a $C_8$-$C_{20}$ backbone that is ethoxylated with from about 1 to about 10 moles of ethylene oxide. Alternatively, the alcohol ethoxy sulfate may be described as having a $C_8$-$C_{20}$ backbone and about 1 to 10 moles of ethylene oxide units bonded thereto. The metal may be any metal but is typically sodium or potassium. The backbone of the surfactant system may have any number of carbon atoms from 8 to 20, e.g. 10 to 18, 12 to 16, 12 to 14, 14 to 16, or 8, 9, 10, 11, 12, 13, 14, 15, 16, 17, 18, 19, or 20, carbon atoms. Various mixtures of alcohol ethoxy sulfates may also be used wherein different length backbones are utilized. The backbone is ethoxylated with from about 1 to about 10, about 2 to about 9, about 3 to about 8, about 4 to about 7, about 5 to about 6, or 1, 2, 3, 4, 5, 6, 7, 8, 9, or 10, moles of ethylene oxide. In various non-limiting embodiments, all values, both whole and fractional, between and including all of the above, are hereby expressly contemplated for use herein.

In various embodiments, the alcohol ethoxy sulfate is further defined as sodium laureth sulfate (SLES) having the formula: $CH_3(CH_2)_{10}CH_2(OCH_2CH_2)_nOSO_3Na$ wherein n is from about 1 to about 10. In another embodiment, the alcohol ethoxy sulfate is sodium laureth sulfate ethoxylated with about 2 to about 4 moles of ethylene oxide. In various non-limiting embodiments, all values, both whole and fractional, between and including all of the above, are hereby expressly contemplated for use herein.

At Least One Non-Ionic Surfactant Including an Alkoxylated Alcohol:

The surfactant system also includes the (2) at least one non-ionic surfactant that comprises, consists essentially of, or consists of, an alkoxylated alcohol. The terminology "at least one" means that one or more than one non-ionic surfactant may be utilized herein.

In one embodiment, the non-ionic surfactant includes an alkoxylated alcohol.

In one embodiment, the non-ionic surfactant consists essentially of an alkoxylated alcohol.

In one embodiment, the non-ionic surfactant consists of an alkoxylated alcohol.

The alkoxylated alcohol may be a $C_8$-$C_{20}$ alcohol that is capped with (or comprises) approximately 2 to 12 moles of an alkylene oxide. In other embodiments, the alkoxylated alcohol may be an alcohol alkoxylate that has from 8 to 20, 10 to 18, 12 to 16, or 12 to 14, carbon atoms and is an ethoxylate, propoxylate, or butoxylate and is capped with an alkylene oxide, e.g. ethylene oxide, propylene oxide, or butylene oxide. The alcohol alkoxylate may be capped with varying numbers of moles of the alkylene oxide, e.g. about 2 to about 12, about 3 to about 11, about 4 to about 10, about 5 to about 9, about 6 to about 8, or about 7 to about 8, moles. In various non-limiting embodiments, all values, both whole and fractional, between and including all of the above, are hereby expressly contemplated for use herein.

At Least One Anionic Surfactant Including a Linear Alkylbenzene Sulfonate

The surfactant system also includes at least one anionic surfactant that comprises, consists essentially of, or consists of, a linear alkylbenzene sulfonate (LAS). The terminology "at least one" means that one or more than one anionic surfactant may be utilized herein.

In one embodiment, the at least one anionic surfactant includes a linear alkylbenzene sulfonate (LAS).

In one embodiment, the at least one anionic surfactant consists essentially of a linear alkylbenzene sulfonate (LAS).

In one embodiment, the at least one anionic surfactant consists of a linear alkylbenzene sulfonate (LAS).

The linear alkylbenzene sulfonate may have a linear alkyl chain that has, e.g. 10 to 13 carbon atoms. These carbon atoms are present in approximately the following mole ratios C10:C11:C12:C13 is about 13:30:33:24 having an average carbon number of about 11.6 and a content of the most hydrophobic 2-phenyl isomers of about 18-29 wt %. The linear alkylbenzene sulfonate may be any known in the art.

In various non-limiting embodiments, all values, both whole and fractional, between and including all of the above, are hereby expressly contemplated for use herein.

In one embodiment, the alcohol ethoxy sulfate is sodium laureth sulfate ethoxylated with about 2 to about 4 moles of ethylene oxide, the linear alkyl benzenesulfonate has a linear alkyl chain that has from about 10 to about 13 carbon atoms, and the alkoxylated alcohol is an ethoxylated alcohol including a $C_8$-$C_{20}$ backbone that is ethoxylated with from about 2 to about 12 moles of ethylene oxide.

In another embodiment, the (1) alcohol ethoxy sulfate is sodium laureth sulfate ethoxylated with about 2 to about 4 moles of ethylene oxide, the (2) alkoxylated alcohol is a $C_{12}$-$C_{15}$ alcohol ethoxylate that is capped with approximately 7 moles of ethylene oxide; and the (3) linear alkyl benzenesulfonate is 2-Phenyl Sulfonic Acid.

In a further embodiment, the (2) alkoxylated alcohol is a $C_{12}$-$C_{15}$ alcohol ethoxylate that is capped with approximately 7 moles of ethylene oxide; and the (3) linear alkyl benzenesulfonate is 2-Phenyl Sulfonic Acid, and the mixture is free of the (1) alcohol ethoxy sulfate.

Additional Surfactants

In other embodiments, one or more additional surfactants may be utilized and may be or include cationic, anionic, non-ionic, and/or zwitterionic surfactants, and/or combinations thereof. Additional anionic surfactants may include soaps which contain sulfate or sulfonate groups, including those with alkali metal ions as cations, can be used. Usable soaps include alkali metal salts of saturated or unsaturated fatty acids with 12 to 18 carbon (C) atoms. Such fatty acids may also be used in incompletely neutralized form. Usable ionic surfactants of the sulfate type include the salts of sulfuric acid semi esters of fatty alcohols with 12 to 18 C atoms. Usable ionic surfactants of the sulfonate type include alkane sulfonates with 12 to 18 C atoms and olefin sulfonates with 12 to 18 C atoms, such as those that arise from the reaction of corresponding mono-olefins with sulfur trioxide, alpha-sulfofatty acid esters such as those that arise from the sulfonation of fatty acid methyl or ethyl esters. In various non-limiting embodiments, all values, both whole and fractional, between and including all of the above, are hereby expressly contemplated for use herein.

Other suitable examples of additional nonionic surfactants include alkyl glycosides and ethoxylation and/or propoxylation products of alkyl glycosides or linear or branched alcohols in each case having 12 to 18 carbon atoms in the alkyl moiety and 3 to 20, or 4 to 10, alkyl ether groups. Corresponding ethoxylation and/or propoxylation products of N-alkylamines, vicinal diols, and fatty acid amides, which correspond to the alkyl moiety in the stated long-chain alcohol derivatives, may furthermore be used. Alkylphenols having 5 to 12 carbon atoms may also be used in the alkyl moiety of the above described long-chain alcohol derivatives. In various non-limiting embodiments, all values, both whole and fractional, between and including all of the above, are hereby expressly contemplated for use herein.

In other embodiments, the additional surfactant is chosen from nonionic and ionic surfactants, such as alkoxylates, polyglycerols, glycol ethers, glycols, polyethylene glycols, polypropylene glycols, polybutylene glycols, glycerol ester ethoxylates, polysorbates, alkyl ether sulfates, alkyl- and/or arylsulfonates, alkyl sulfates, ester sulfonates (sulfo-fatty acid esters), ligninsulfonates, fatty acid cyanamides, anionic sulfosuccinic acid surfactants, fatty acid isethionates, acylaminoalkane-sulfonates (fatty acid taurides), fatty acid sarcosinates, ether carboxylic acids and alkyl(ether)phosphates. In such embodiments, suitable nonionic surfactants include $C_2$-$C_6$-alkylene glycols and poly-$C_2$-$C_3$-alkylene glycol ethers, optionally, etherified on one side with a $C_1$-$C_6$-alkanol and having, on average, 1 to 9 identical or different, typically identical, alkylene glycol groups per molecule, and also alcohols and fatty alcohol polyglycol ethers, typically propylene glycol, dipropylene glycol, trimethylolpropane, and fatty alcohols with low degrees of ethoxylation having 6 to 22, typically 8 to 18, more typically 8 to 12, and even more typically 8 to 11, carbon atoms. Moreover, suitable ionic surfactants include alkyl ether sulfates, sulfosuccinic acid surfactants, polyacrylates and phosphonic acids, typically lauryl sulfate, lauryl ether sulfate, sodium sulfosuccinic acid diisooctyl ester, 1-hydroxyethane-1,1-diphosphonic acid, and diacetyltartaric esters. In various non-limiting embodiments, all values, both whole and fractional, between and including all of the above, are hereby expressly contemplated for use herein.

The one or more additional surfactants may be part of the surfactant system, as described above, or may be independent from the surfactant system. In various embodiments, the one or more additional surfactants is or includes an additional anionic surfactant and/or a non-ionic surfactant. However, other surfactants such as cationic and/or zwitterionic (amphoteric) surfactants may also be utilized or may be excluded from the composition.

Water

The detergent composition also includes water. Water is present in the composition in a total amount of from about 30 to about 90 weight percent based on a total weight of the composition. In various embodiments, the water is present in an amount of from about 30 to about 85, about 35 to about 80, or about 45, 50, 55, 60, 65, 70, 75, 80 or 85, weight percent based on a total weight of the composition. Typically, the terminology "total amount" refers to a total amount of water present in the composition from all components, i.e., not simply water added independently from, for example, the surfactant system. In various non-limiting embodiments, all values, both whole and fractional, between and including all of the above, are hereby expressly contemplated for use herein.

Free Fatty Acid

The detergent composition also includes a free fatty acid component that may be derived from palm kernel or coconut. Suitable free fatty acid may be any fatty acid having formula: $R_3$—C(O)OH, wherein $R_3$ is a $C_5$-$C_{21}$ linear or branched aliphatic group. Preferably, the $R_3$ is a $C_{13}$-$C_{21}$ linear or branched aliphatic group. In a preferred embodiment, the fatty acid is dodecanoic acid (also known as coconut fatty acid).

In addition to its free acid form, a salt form of the acid is encompassed by the scope of the invention. For example, instead of using $R_3$—C(O)OH, one may use $R_3$—C(O)$O^-$ $M^+$ in a liquid detergent composition as long as that after mixing the free acid form is released from the salt form. The final form of $R_3$—C(O)OH or $R_3$—C(O)$O^-$ depends on the pH and counter ion in a liquid composition.

Free fatty acid or a salt thereof is present in the composition in a total amount of from about 1 to about 15 weight percent based on a total weight of the composition. In various embodiments, the free fatty acid is present in an amount of from about 1.2 to about 13, about 1.3 to about 12, about 1 to about 10, from about 1 to about 8, from about 1 to about 7, or about 1, 1.5, 2, 2.5, 3, 4, 5, 6, 7, 8, 9, 10, 11, 12, 13, 14, or 15, weight percent based on a total weight of the composition.

Magnesium Cation

The detergent composition also includes a magnesium cation component for triggering the transition of the detergent composition from liquid to gel. The magnesium cation component that may be derived from the following salts: magnesium chloride, magnesium sulfite, magnesium bisulfate, magnesium sulfate. However, any anion may work with magnesium cation. In other words, any magnesium salt is within the scope of the invention. Further, the magnesium salt may be in a hydrate form. An exemplary magnesium chloride includes magnesium chloride hexahydrate.

The magnesium cation is present in the composition in a total amount of from about 0.05 to about 1.0 weight percent based on a total weight of the composition. In various embodiments, the magnesium cation is present in an amount of from about 0.05 to about 0.75, 0.075 to about 0.65, about 0.1 to about 0.75, about 0.1 to about 0.6, or about 0.2, 0.3, 0.4, 0.5, 0.6, 0.7, 0.8, 0.9, or 1.0 weight percent based on a total weight of the composition.

Upon adding a magnesium salt, the composition transitions into a fluid gel over time. The magnesium-based, fluid gel composition significantly reduces or prevents the gravitational separation of colloidal particles such as encapsulated fragrance. A fluid gel also enables different types of dosing methods for the consumer. Further, as will be discussed in detail later, this approach details methods to create an in-process, structured liquid detergent that requires no pre-mixes or opacifying polymers.

Colloidal Materials

The composition may include one or more colloidal materials such as encapsulated fragrance and other beneficial materials. Other beneficial materials may be included, such as vitamin E acetate, skin care oils and acids, fabric care polymers. The beneficial materials may be encapsulated and form a particle size from 0.1 to 500 microns with a density of 0.8 to 1.25 g/mL.

In some embodiments, the preferred liquid composition comprises at least one encapsulated fragrance. In some embodiments, the liquid composition comprises from 1 to 5, 1 to 4, 1 to 3, 1 to 2, 2 to 5, 2 to 4, 2 to 3, 3 to 5, 3 to 4, or 4 to 5 different types of encapsulated fragrances. In some embodiments, the liquid composition comprises 1, 2, 3, 4, or 5 different types of encapsulated fragrances. In some embodiments, the liquid composition comprises 1 encapsulated fragrance.

In some embodiments, the fragrance is encapsulated in, for example, a water-insoluble shell, a microcapsule, a nanocapsule, or any combination thereof.

In some embodiments, the at least one encapsulated fragrance is encapsulated in a microcapsule. Microencapsulation is a technique by which one material (normally active) is coated with another material or system. The major purposes for using microencapsulation is to isolate incompatible substances present in the same formulation and to control the release of the active ingredient encapsulation. This release can be due to the diffusion of the active through the wall material (sustained release over time), or it can be due to the breakage of the wall capsule (fast release).

In some embodiments, the at least one encapsulated fragrance has a musky scent, a putrid scent, a pungent scent, a camphoraceous scent, an ethereal scent, a floral scent, a peppermint scent, or a combination thereof.

In some embodiments, the at least one encapsulated fragrance comprises an ester, an ether, an aldehyde, a ketone, an alcohol, a hydrocarbon, or any combination thereof. In some embodiments, the at least one encapsulated fragrance comprises methyl formate, methyl acetate, methyl butyrate, ethyl butyrate, isoamyl acetate, pentyl butyrate, pentyl pentanoate, octyl acetate, myrcene, geraniol, nerol, citral, citronellol, linalool, nerolidol, limonene, camphor, terpineol, alpha-ionone, thuj one, benzaldehyde, eugenol, cinnamaldehyde, ethyl maltol, vanillin, anisole, anethole, estragole, thymol, indole, pyridine, furaneol, 1-hexanol, cis-3-hexenal, furfural, hexyl cinnamaldehyde, fructone, hexyl acetate, ethyl methyl phenyl glycidate, dihydrojasmone, oct-1-en-3-one, 2-acetyl-1-pyrroline, 6-acetyl-2,3,4,5-tetrahydropyridine, gamma-decalactone, gamma-nonalactone, delta-octalone, jasmine lactone, massoia lactone, wine lactone, sotolon, grapefruit mercaptan, methanthiol, methyl phosphine, dimethyl phosphine, nerolin, 2,4,6-trichloroanisole, or a combination thereof.

In some embodiments, the encapsulated fragrance is a 50:50 weight ratio premix of glycerine:encapsulated fragrance. In some commercial embodiments, the encapsulate is supplied between 10 to 50% active encapsulate in solution.

In some embodiments, the liquid composition comprises by weight about 0.05% to about 5% of colloidal particles. In some embodiments, the liquid composition comprises by weight about 0.1% to about 3.5%, about 0.15% to about 2.5%, about 0.2% to about 1.5%, about 0.15% to about 0.75%, about 0.15% to about 0.5% of colloidal particles.

In some embodiments, creaming (rising to the surface) or sedimentation (settling to the bottom) of colloidal particles (e.g., encapsulated fragrances) occurs over time, especially during storage of the product. The creaming or sedimentation is due to differences in density between the microcapsule and the surrounding liquid. Many consumer products including liquid household cleaners, liquid laundry products, personal care products, and cosmetic products have densities around 1.01 to 1.1 g/mL, while many organic compounds have densities much lower than 1 g/mL.

To prevent the creaming or sedimentation of colloidal particles such as encapsulated fragrance, it is necessary to structure the liquid detergent so it has a yield, preferably a yield point greater than 0.075 Pa.

Additives

The composition may include one or more of the following additives or may be free of one or more of the following additives.

In other embodiments, additives may be or include neutralizers/pH adjustors just as monoethanolamine and the like, enzymes, optical brighteners, free oil fragrance, chelators, yellowing control agents (i.e. sodium sulfite) and combinations thereof. These additives may be chosen from any known in the art. In additional embodiments, the composition may be free of enzymes or may be including in multiple chamber unit dose products, into a chamber that is free of enzymes.

Weight Percents/Ratios of Various Components:

The surfactant system, free fatty acid, water, encapsulated fragrance and magnesium cation component are generally present in amounts within the weight ranges set forth above. However, in additional embodiments, these weight ranges may be narrower and/or specific weight ratios may be utilized. These weight ranges and/or ratios may be representative of embodiments that produce special, superior, and unexpected results, such as those demonstrated in the Examples. Relative to all of the paragraphs set forth immediately below, in various non-limiting embodiments, all values, both whole and fractional, between and including all of the above, are hereby expressly contemplated for use herein.

Without being bound by theory, it is believed that the magnesium cation and the free fatty acid are interacting with one another to form stable crystal structures, that are finely dispersed throughout the entire liquid composition, giving a "milky white", opacified appearance. When enough crystals are dispersed, it is believed that this creates a yield within the liquid, which enable the suspension of encapsulated fragrances or other colloidal materials.

In some embodiments, the weight ratio between a free fatty acid and a magnesium salt is from about 10:1 to 1:10, from about 9:1 to 1:9, from about 8:1 to 1:8, from about 7:1 to 1:7, from about 6:1 to about 1:6, from about 5:1 to 1:5, from about 4:1 to 1:4, from about 3:1 to about 1:3, from about 2:1 to 1:2, about 2:1, about 3:1, about 4:1, about 5:1, about 1:5, about 1:4, about 1:3, about 1:2, or about 1:1.

In some preferred embodiments, the weight ratio between a free coconut fatty acid and a magnesium cation is from about 20:1 to about 3:1, from about 18:1 to about 4:1, from about 15:1 to about 5:1, from about 5:1 to 1:5, from about 4:1 to 1:4, from about 3:1 to about 1:3, from about 2:1 to 1:2, about 15:1, about 10:1, about 6:1, about 4.5:1, about 3:1, about 2:1, or about 1:1.

Surprisingly, the magnesium-based, structured detergent composition creates a yield in the liquid. Before the yield point; the liquid has an elastic behavior and after the yield point, the liquid has a plastic behavior. While the liquid is in the elastic behavior phase (i.e. prior to the yield point), the liquid behaves similar to a solid or thick (high viscosity) liquid and can prevent the flow of the liquid under low stress conditions. When enough stress is placed on the structured liquid, the liquid begins to behave like a low viscosity liquid and can no longer prevent flow (plastic behavior). When the stress is removed from a system, the liquid may shift back from plastic to elastic behavior and will regain the ability to suspend particles. A yield point can be measured using a standard rheometer, where increasing shear stress is slowly applied to the liquid until enough stress is applied to shear or strain the liquid.

For liquid detergent formulations that have at least 30% water and are typically sold to consumers in plastic bottles, it is critical for the encapsulated fragrance to remain distributed throughout the detergent as homogeneously as possible. Separation of the encapsulated fragrance overtime such as gravitational separation (settling at the bottom of the container or rising to the top) or coagulation (particles sticking together) causes the detergent to have striated layers of varying fragrance and can connotate that the detergent is unstable or expired and should not be used by the consumer since each dose of detergent will provide a different level of fragrance to the wash load.

In one embodiment, the magnesium derived structured liquid composition of the present disclosure is stable for at least 1 week, at least 1 month, at least 3 months, at least 6 months or at least 1 year at 75° F.

In various embodiments, the yield point (Pa) of the composition of the present disclosure is greater than about 0.075, greater than about 0.1, greater than about 0.125, greater than about 0.15, greater than about 0.25, greater than about 0.5, greater than about 1, greater than about 1.5, greater than about 2 at 75° F.

Typically, liquid compositions that have a yield point greater than 0.075 Pa is sufficient to significantly reduce or eliminate gravitational separation of colloidal particles. Liquid compositions that have a yield point greater than 0.1 Pa has a stronger yield effect. Accordingly, the magnesium derived structured liquid composition of the present disclosure provides the desired rheology for stably suspending colloidal particles and for easily dispersing from a container so that each dose, from the first dose to the last dose, has consistent amounts of different components.

Another benefit of the magnesium derived structured liquid composition of the present disclosure is that Mg salt is 100% biodegradable. No opacifying or structuring polymers are needed to provide the structuring and opacifying benefits.

Method of Forming a Liquid Detergent Composition

This disclosure further provides a method of forming the detergent composition. The method includes the step of first combining the surfactant system, water, free fatty acid and optionally additives such as non-aqueous solvents (propylene glycol, glycerin, ethanol), free oil (unencapsulated) fragrance, enzymes, non-opacification polymers, or chelators. Then the magnesium cation is added in the form of a salt (e.g. magnesium chloride) to the detergent composition, which causes an instantaneous opacification and structuring effect to occur. The encapsulated fragrance can be added before or after the magnesium. Each of the aforementioned components may be combined in any order and in whole or partial amounts, but it is preferred for the magnesium cation to be added as the last material to the composition. All orders of addition are hereby expressly contemplated for use in various non-limiting embodiments.

After a sufficient amount of magnesium cation is added, an instantaneous, micro-plastic free opacification and structuring of the laundry detergent is created. The magnesium-based, structured detergent composition significantly reduces or prevents the gravitational separation of colloidal particles such as encapsulated fragrance. The features allow the manufacturing of an in-process, structured liquid detergent that requires no pre-mixes or opacifying polymers.

Specifically, in one embodiment, the method of preparing a liquid detergent composition comprises a step of mixing a surfactant system, a fatty acid or a salt thereof, water, and at least one addictive ingredient and/or at least one non-aqueous solvent to form a first mixture, wherein the first mixture does not include a magnesium salt, followed by a step of mixing the first mixture with a magnesium salt, wherein the magnesium salt comprises a magnesium cation component and a counterion component.

In some embodiments, the surfactant system is present in an amount of about 7 to about 50 weight percent based on a total weight of the detergent composition and comprises: (1) an alcohol ethoxy sulfate having a $C_8$-$C_{20}$ backbone that is ethoxylated with from about 1 to about 10 moles of ethylene oxide; (2) at least one non-ionic surfactant comprising an alkoxylated alcohol; and (3) at least one another anionic surfactant comprising a linear alkylbenzene sulfonate.

In some embodiments, water is present in a total amount of from about 30 to about 90 weight percent based on a total weight of the detergent composition.

In some embodiments, the free fatty acid or a salt thereof is present in an amount of from about 1 to about 8 weight percent based on a total weight of the detergent composition, wherein the salt of the fatty acid is capable of being neutralized in the composition to release the free fatty acid.

The magnesium salt is composed of a magnesium cation component and a counterion component. In some embodiments, the magnesium cation component is present in an amount of from about 0.05 to about 1.0 weight percent based on a total weight of the detergent composition. The magnesium salt may be selected from magnesium chloride, magnesium sulfite, magnesium bisulfite, or magnesium sulfate.

In some embodiments, the composition is free of a structuring polymer and free of an opacifying agent. In others, the composition is free of crystallized triglycerides.

Colloidal particles (e.g., an encapsulated fragrance) may be added into the first or the second step for mixing, although preferably they are added during the first step. The mixing shall continue at least until the colloidal particles are homogenously dispersed in the composition.

Encapsulated fragrance is typically supplied as a 10 to 75 weight percent of encapsulates in solution of water and non-aqueous solvents such as glycerin and/or propylene glycol. While the encapsulated fragrance solution may be added directly into the mixture. It has been discovered that pre-diluting it at a 50:50 weight ratio of glycerine:encapsulated fragrance solution allows for better dispersion of the encapsulated fragrance in the detergent composition. Accordingly, the method may further comprise a step of pre-diluting an encapsulated fragrance at a 50:50 weight ratio of glycerine:encapsulated fragrance solution before mixing it with the other components.

During the second step, after the addition of a magnesium salt, the mixture becomes instantaneously opacified with turbidity value greater than 250 NTU at 20° C. and has a yield point greater than 0.075 Pa.

Before the yield point is reached, the detergent composition acts as a gel or plastic so it can stably suspend the colloidal particles. After the yield point is reached upon applying sheer stress onto the composition, the composition flows freely. This enables the dispensing of the composition from a container, as needed. When the sheer stress is released from the composition, the composition goes back to a gel or plastic stage, allowing the composition to stably suspend the colloidal particles.

In a preferred embodiment, the second step of mixing with a magnesium salt is conducted from 0.1 second to 5 hours prior to a step of packaging the resulting mixture to a container. This allows the mixture to be in a liquid stage before it is transferred into a container, as it would be more difficult to fill a container when the mixture is in a gel stage during production. The liquid generally sets into a gel within 1 to 3 days. Preferably, transporting the container will filled mixture is performed after the gel has been formed. Thus, the method of the present application may further comprise: packing and/or shipping the detergent laundry detergent into a container before the detergent composition is settled into a gel stage.

Liquid Laundry Embodiment

This disclosure also provides a liquid laundry embodiment. For example, the composition may include amounts of water and/or any of the other components suitable for a liquid laundry application, as understood by those of skill in the art.

EXAMPLES

Example 1

The following experiment was used to measure the surprising effect that Magnesium cation had to opacify and structure a liquid laundry composition. Composition 1 (below) was created with a 11% hole to add different use-levels of magnesium.

TABLE 1

| COMPONENT | COMPOSITION # 1 ACTIVITY % | USE-LEVEL w/w % |
|---|---|---|
| C12-C15 Alcohol Ethoxylate 7EO | 100.0 | 13.47 |
| Optical Brightener | 68.0 | 0.13 |
| DI Water | 100.0 | 50.00 |
| Citric Acid | 50.0 | 4.50 |
| NaOH 50% | 50.0 | 3.61 |
| Triethanolamine | 85.0 | 0.76 |
| Linear Alkylbenzene Sulfonic Acid | 96.0 | 1.82 |
| Coconut Fatty Acid | 100.0 | 2.25 |
| Calcium Chloride | 100.0 | 0.05 |
| Antiredeposition Polymer | 45.00 | 0.17 |
| Tetra Sodium Iminodi succinate | 34.00 | 0.96 |
| Dye | 1.0 | 1.50 |
| Preservative | 100.0 | 0.06 |
| Enzymes | 100.0 | 0.30 |
| QS Water | | QS to 89 |
| Hole | N/A | 11 |
| Total | | 100 |

Table 2 below sets forth ratios of active levels of salts that contain different levels of magnesium (derived from Magnesium Chloride Hexahydrate (MgCl2*6H2O). Each level of Magnesium was postdosed separately into Composition 1 and given 24 hours prior to reading the results. Composition 1 was then separately post-dosed with 0, 0.5%, 1%, 1.5%. 2%, 2.5%, 3%, 3.5%, or 4% on active basis of MgCl2*6H2O. The MgCl2*6H2O was dissolved in water as a 64% active solution in water for post-dosing. Thereafter, each composition was further QS'd with water to make the materials equal to 100 weight percent in the formula. QS refers to adding a component of choice to the composition until a desired weight percent is reached. The following compositions were created (Compositions 2 to 10).

After formation, the NTU value was measured by a Turbidity Meter (2100N Lab Turbidimeter, EPA, 115 Vac by Hach). Turbidity values below 10 are considered transparent whereas turbidity values above 1000 are considered significantly opacified.

After formation, each composition was evaluated to determine viscosity at 20° C., cp, using an AR2000-EX Rheometer at a shear rate of 3.2 l/s with a geometry cone of 40 mm, 1:59:49 degree:min:sec, and a truncation gap of 52 microns.

After formation, separation indices are measured on a LUMiSizer 12-channel instrument (manufactured by LUM). Approximately 0.4 mL of liquid composition into a 2 mm polyamide synthetic cells and spun at 855 g-force for approximately 3 hours at a Light Factor of 1 and at 25 degrees Celsius. Using LUM's SEPview 6 software, the separation index is determined by reading the sample cell between 115.2 mm and 129.7 mm. Separation indices range from 0 to 1.0 with 0 signifying 0% separation (completely stable) and 1.00 signifying 100% separation. Anything less than 0.2 was considered stable. This test roughly represents that amount of separation that would occur after approximately 2565 hours at 25 degrees Celsius at 1 g-force (i.e. standard room temperature stability). 2565 hours is determined by multiplying 855 (the amount of g-force of the test) times the time in the test (3 hours). 2565 hours is approximately 15 weeks of stability.

After formation, each composition was evaluated to determine the yield point (Pa) at 20° C. using an AR2000-EX Rheometer with a geometry cone of 40 mm, 1:59:49 degree: min:sec, and a truncation gap of 52 microns. After each composition was loaded on the instrument, the sample was conditioned with a 30 minute rest at 20° C. prior to the measurement. The procedure was a stepped flow, with the shear stress (Pa) ramping from 0 to 50 Pa, in log mode and with 10 points per decade. The procedure was run at 20° C. with a 35 second constant time and an average that lasted 5 seconds.

TABLE 2

| | MgCl2*6H20, 64% active in water (wt %) | Turbidity (NTU) | Viscosity at 20 C. (cP at 3.21/s) | Stable after 3 days at 75 F. (Response is no if phase separation occurred) | Separation Index after 3 hours at ~855 g-force (LUMiSizer) | Yield Point (Pa) [Considered significant if asterisked) |
|---|---|---|---|---|---|---|
| Composition 2 | 0 | 5 | 400 | N/A | N/A | 0.014 |
| Composition 3 | 0.5 | 5 | 480 | N/A | N/A | 0.006 |
| Composition 4 | 1 | 500 | 470 | No | 0.172 | 0.009 |
| Composition 5 | 1.5 | 600 | 420 | Yes | 0.055 | 0.077* |
| Composition 6 | 2 | 2400 | 550 | Yes | 0.01 | 1.879* |
| Composition 7 | 2.5 | 2400 | 510 | Yes | 0.001 | 3.691* |
| Composition 8 | 3 | 4000+ | 1000 | Yes | 0.036 | 1.886* |
| Composition 9 | 3.5 | 4000+ | 1200 | Yes | 0.032 | 2.991* |
| Composition 10 | 4 | 4000+ | 2300 | Yes | 0.001 | 2.991* |

The C12-C15 Alcohol Ethoxylate is a C12-C15 Alcohol Ethoxylate that is capped with approximately 7 moles of ethylene oxide.

Linear Alkylbenzene Sulfonic Acid is 2-Phenyl Sulfonic Acid.

Alcohol Ethoxy Sulfate is C12-C15 with 3 moles of ethoxylation.

Magnesium Chloride Hexahydrate is available from VWR.

Compositions 2, 3, and 4 produced no structuring effect and compositions 2 and 3 did not produce an opacification effect.

Compositions 5 to 10 provided a strong structuring effect due to the higher inclusion of magnesium cation (Yield Point was above 0.075 Pa). Compositions 5 to 10 also exhibited significant improvement for gravitational separation, with Separation Indices less than 0.1 as well as exhibited no phase separation after 3 days at 75 F. Compositions 1 and 2 did not have a Separation Index (since turbidity is required to measure separation) and Composition 3 was not stable due to a Separation Index greater than 0.1 as well as exhibiting phase separation before 3 days.

Compositions 5 to 10 were then placed into glass jars for stability testing at 0 F, 40 F, 75 F, 105 F, and 125 F. The samples were evaluated weekly at all temperatures for 4 weeks. All samples did not exhibit phase separation and provided good opacification for the time tested.

Example 2

The following experiment was used to measure the effect that Magnesium cation had to suspend encapsulated fragrances. Composition 11 (below) was created with a 5.15% hole (i.e. Composition 11 added up to 94.85%). Afterwards, different levels of magnesium salt and encapsulated fragrances were then added into Composition 11 to create Compositions 12, 13, 14, and 15. After the addition of magnesium salt and encapsulated fragrance, additional water was added to QS the compositions to 100%.

TABLE 3

| COMPONENT | COMPOSITION # 11 ACTIVITY % | USE-LEVEL w/w % |
|---|---|---|
| C12-C15 Alcohol Ethoxylate 7EO | 100.0 | 13.47 |
| Optical Brightener | 68.0 | 0.13 |
| DI Water | 100.0 | 50.00 |
| Citric Acid | 50.0 | 4.50 |
| NaOH 50% | 50.0 | 3.61 |
| Betaine Surfactant | 37.5 | 2 |
| Triethanolamine | 85.0 | 0.76 |
| Linear Alkylbenzene Sulfonic Acid | 96.0 | 1.82 |
| Coconut Fatty Acid | 100.0 | 2.25 |
| Calcium Chloride | 100.0 | 0.05 |
| Antiredeposition Polymer | 45.00 | 0.17 |
| Tetra Sodium Iminodi succinate | 34.00 | 0.96 |
| Dye | 1.0 | 1.50 |
| Preservative | 100.0 | 0.06 |
| Enzymes | 100.0 | 0.30 |
| QS Water | | QS to 94.85 |
| Hole | N/A | 5.15 |
| Total | | 100 |

Table 4 below sets forth ratios of active levels of salts that contain different levels of magnesium (derived from Magnesium Chloride Hexahydrate (MgCl2*6H2O)). Each level of Magnesium was postdosed separately into Composition 11 (as a 64% MgCl2*6H2O active solution in water), and then the encapsulated fragrance was dosed at 1.5% (approximately 10% active encapsulated fragrance) to form Composition 12, 13, and 14. Composition 15 did not contain any magnesium and only contained encapsulated fragrance. Each composition was then QS'd with water to make the materials equal to 100 weight percent in the formula. The following compositions were created (Compositions 12 to 15).

TABLE 4

| | MgC12*6H20, 64% in water (w/w %) | Encapsulated Fragrance (10% active in water) | Viscosity at 20 C. (cP at 3.21/s) | Separation Index after 3 hours at ~855 g-force (LUMiSizer) | Yield Point (Pa) [Considered significant if asterisked] |
|---|---|---|---|---|---|
| Composition 12 | 1 | 1.5 | 500 | 0.05 | 0.2371* |
| Composition 13 | 1.5 | 1.5 | 510 | 0.03 | 0.3765* |
| Composition 14 | 2 | 1.5 | 490 | 0.01 | 1.187* |
| Composition 15 | 0 | 1.5 | 480 | 0.11 | 0.005 |

After formation, each composition was evaluated to determine viscosity at 20° C., cp, using an AR2000-EX Rheometer at a shear rate of 3.2 l/s with a geometry cone of 40 mm, 1:59:49 degree:min:sec, and a truncation gap of 52 microns.

After formation, separation indices are measured on a LUMiSizer 12-channel instrument (manufactured by LUM). Approximately 0.4 mL of liquid composition into a 2 mm polyamide synthetic cells and spun at 855 g-force for approximately 21 minutes at a Light Factor of 1 and at 25 degrees Celsius. Using LUM's SEPview 6 software, the separation index is determined by reading the sample cell between 113.5 mm and 121.7 mm. Separation indices range from 0 to 1.0 with 0 signifying 0% separation (completely stable) and 1.00 signifying 100% separation. Anything less than 0.05 was considered stable (due to shorter duration of test versus Example 1). This test roughly represents that amount of separation that would occur after approximately 1800 minutes at 25 degrees Celsius at 1 g-force (i.e. standard room temperature stability). 1800 minutes is determined by multiplying 855 (the amount of g-force of the test) times the time in the test (21 minutes). 1800 minutes is approximately 12 days of stability.

After formation, each composition was evaluated to determine the yield point (Pa) at 20° C. using an AR2000-EX Rheometer with a geometry cone of 40 mm, 1:59:49 degree:min:sec, and a truncation gap of 52 microns. After each composition was loaded on the instrument, the sample was conditioned with a 30 minute rest at 20° C. prior to the measurement. The procedure was a stepped flow, with the shear stress (Pa) ramping from 0 to 50 Pa, in log mode and with 10 points per decade. The procedure was run at 20° C. with a 35 second constant time and an average that lasted 5 seconds.

Betaine surfactant is available from Stepan as Amphosol CG-50.

Encapsulated Fragrance is available as Juicy Burst EAH31838/00 available from Givaudan.

Composition 12, 13, and 14 produced a structured effect that was capable of minimizing or eliminating gravitational instability from the encapsulated fragrance. Composition 15 did not contain any magnesium salt, was not considered structured, and could not prevent the gravitational separation of the encapsulated fragrance.

Having now fully described this invention, it will be understood by those of ordinary skill in the art that the same can be performed within a wide and equivalent range of conditions, formulations and other parameters without affecting the scope of the invention or any embodiment thereof. All patents, patent applications and publications cited herein are fully incorporated by reference in their entirety.

The foregoing description of the specific embodiments has revealed the general nature of the invention such that others can, by applying knowledge within the skill of the art, readily modify and/or adapt for various applications such specific embodiments, without undue experimentations, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

What is claimed is:

1. A fluid-gel detergent composition having a yield for transitioning between a gel stage and a fluid stage under sheer stress comprising:

A. a surfactant system present in an amount of about 7 to about 50 weight percent based on a total weight of said detergent composition and comprising;

(1) at least one non-ionic surfactant comprising an alkoxylated alcohol; and (2) at least one anionic surfactant comprising a linear alkylbenzene sulfonate;

B. water present in a total amount of from about 30 to about 90 weight percent based on a total weight of said detergent composition; and C. a free fatty acid or a salt thereof present in an amount of from about 1 to about 15 weight percent based on a total weight of said detergent composition, wherein the salt of the fatty acid is capable of being neutralized in the composition to release the free fatty acid; and D. a magnesium salt comprising a magnesium cation component and a counterion component, wherein the magnesium cation component is present in an amount of from about 0.077 to about 1.153 weight percent based on a total weight of said detergent composition; and E. colloidal particles, wherein the colloidal particles comprise an encapsulated fragrance and are homogenously dispersed in said detergent composition; wherein the surfactant system is free of alcohol ethoxy sulfate;

wherein said detergent composition has a yield point value greater than 0.075 Pa at 20° C.;

wherein before the yield point is reached, said detergent composition acts as a gel or plastic; and wherein after the yield point is reached upon applying sheer stress onto said detergent composition, said detergent composition flows freely.

2. The detergent composition of claim 1, wherein releasing sheer stress from the detergent composition allows the detergent composition to transition back to a gel or plastic stage.

3. The detergent composition of claim 1, wherein a weight ratio between the fatty acid and the magnesium salt is from 2:1 to 30:1.

4. The detergent composition of claim 1, wherein the magnesium cation component is derived from magnesium chloride, magnesium sulfite, magnesium bisulfite, or magnesium sulfate.

5. The detergent composition of claim 1, wherein the encapsulated fragrance is present in an amount of about 0.02 to 1 weight percent based on the total weight of said detergent composition.

6. The detergent composition of claim 1, wherein the detergent composition has a turbidity value greater than 250 NTU and stably disperses the colloidal particles over a shelf life between 1 and 30 months at room temperature.

7. The detergent composition of claim 1, wherein the detergent composition is free of a structuring agent and free of an opacifying agent.

8. The detergent composition of claim 7, wherein the detergent composition is free of a crystallized triglyceride.

9. The detergent composition of claim 8, wherein the detergent composition is free of hydrogenated castor oil.

10. The detergent composition of claim 1, wherein the detergent composition comprises at least one additive ingredient including enzymes, free oil fragrance, chelators, or non-structuring performance polymers.

11. A method of forming a fluid-gel detergent composition according to claim 1, said method comprising the steps of:

A. mixing the surfactant system, the fatty acid or the salt thereof, water, and at least one additive ingredient to form a first mixture, wherein the first mixture does not include the magnesium salt;

B. mixing the first mixture with the magnesium salt, wherein the magnesium salt comprises a magnesium cation component and a counterion component; and C mixing the colloidal particles in Step A or Step B;

wherein after the addition of the magnesium salt, the mixture becomes instantaneously opacified with turbidity value greater than 250 NTU at 20° C. and has a yield point greater than 0.075 Pa;

wherein before the yield point is reached, said detergent composition acts as a gel or plastic; and wherein after the yield point is reached upon applying sheer stress onto said detergent composition, said detergent composition flows freely.

12. The method of claim 11, wherein the colloidal particles is present in an amount of about 0.02 to 5.0 weight percent based on the total weight of said detergent composition.

13. The method of claim 11, further comprising a step of packing the detergent composition into a container before the detergent composition is settled into a gel stage.

14. The method of claim 11, wherein the first mixture is free of a structuring polymer and free of an opacifying agent.

15. The method of claim 11, wherein the first mixture is free of crystallized triglycerides.

16. The method of claim 11, wherein the magnesium cation component is derived from magnesium chloride, magnesium sulfite, magnesium bisulfite, or magnesium sulfate.

17. The method of claim 11, wherein the at least one additive ingredient is selected from a group consisting of enzymes, free oil fragrance, chelators, and non-structuring performance polymers.

* * * * *